United States Patent [19]

Stettner

[11] 4,279,841

[45] Jul. 21, 1981

[54] CARBURETOR WITH IMPROVED CHOKE MECHANISM

[75] Inventor: Ernest R. Stettner, Spencerport, N.Y.

[73] Assignee: General Motors Corporation, Detroit, Mich.

[21] Appl. No.: 65,133

[22] Filed: Aug. 9, 1979

[51] Int. Cl.[3] ..... F02M 7/20

[52] U.S. Cl. ..... 261/23 A; 261/52; 261/121 B; 261/DIG. 74; 261/50 R; 123/438

[58] Field of Search ..... 261/69 R, 52, DIG. 74, 261/64 C, 50 R, 50 A, 121 B, 23 A; 123/108, 64 R, 119 EC, 119 F, 438, 440

[56] References Cited

U.S. PATENT DOCUMENTS

| | | | |
|---|---|---|---|
| 1,577,766 | 3/1926 | Sisson . | |
| 2,225,943 | 12/1940 | Schweiss . | |
| 2,684,057 | 7/1954 | Bolton . | |
| 2,789,801 | 4/1957 | Durbin | 261/DIG. 18 |
| 2,981,245 | 4/1961 | Sarto | 261/39 B |
| 2,998,233 | 8/1961 | Marsee | 261/39 B |
| 3,172,251 | 3/1965 | Johnson | 60/29 |
| 3,313,532 | 4/1967 | Carlson et al. | 261/39 B |
| 3,396,948 | 8/1968 | Stettner | 261/50 A |
| 3,534,720 | 10/1970 | DuBois . | |
| 3,744,346 | 7/1973 | Miner et al. . | |
| 3,800,766 | 4/1974 | Schubeck | 261/67 |
| 3,807,172 | 4/1974 | Masaki | 261/69 R |
| 3,912,796 | 10/1975 | Brown | 261/69 R |
| 3,933,951 | 1/1976 | Fischer et al. | 261/67 |
| 3,939,654 | 2/1976 | Creps | 261/69 R |
| 3,948,231 | 4/1976 | Smith | 123/108 |
| 3,948,240 | 4/1976 | Hirosawa et al. . | |
| 3,978,835 | 9/1976 | Fenton . | |
| 3,982,517 | 9/1976 | Fales et al. . | |
| 4,011,844 | 3/1977 | Hirosawa et al. . | |
| 4,033,712 | 7/1977 | Morton . | |
| 4,051,824 | 10/1977 | Sugiura | 261/69 R |
| 4,075,993 | 2/1978 | Bertling . | |
| 4,083,342 | 4/1978 | Bertling . | |
| 4,129,623 | 12/1978 | Rogerson et al. | 261/52 |
| 4,135,482 | 1/1979 | Bier et al. | 261/69 R |
| 4,175,103 | 11/1979 | Stoltman | 261/67 |
| 4,177,225 | 12/1979 | Berkbigler | 261/50 A |
| 4,183,335 | 1/1980 | Asano | 123/119 EC |

*Primary Examiner*—Tim R. Miles

*Attorney, Agent, or Firm*—C. K. Veenstra

[57] ABSTRACT

A carburetor choke plate is rotated by a driver in one direction from its wide open position for cold enrichment and in the opposite direction from its wide open position for stoichiometric air-fuel ratio control. A fast idle cam limits throttle closure during operation in the cold enrichment mode, and a stop limits movement of the main metering rod toward its rich position in the stoichiometric air-fuel ratio control mode. The choke mechanism also positions an idle bleed valve to vary idle air-fuel ratio, and controls a latch to prevent secondary operation, during both the cold enrichment and the stoichiometric air-fuel ratio control modes.

5 Claims, 5 Drawing Figures

CARBURETOR WITH IMPROVED CHOKE MECHANISM

TECHNICAL FIELD

This invention relates to a carburetor having a choke mechanism with expanded capability to control a variety of carburetor functions.

BACKGROUND

An internal combustion engine carburetor normally has a choke mechanism which provides an enriched part throttle air-fuel mixture during cold engine operation. The choke mechanism normally also operates certain supplementary controls such as a fast idle cam to limit closure of the carburetor throttle during cold engine operation and a latch to prevent opening of the secondary air valve during cold engine operation.

On at least one other occasion, it was proposed that the choke mechanism be used to maintain a stoichiometric air-fuel mixture during warm engine operation as well as provide an enriched mixture during cold engine operation. However, no provision was made for control of other carburetor functions in a desired manner.

SUMMARY OF THE INVENTION

This invention provides a carburetor having an improved choke mechanism which may be used both for cold enrichment and for air-fuel ratio control during warm engine operation while accommodating a variety of other carburetor functions in a desired manner.

In the present embodiment of this invention, the choke mechanism includes a choke plate which is rotated in one direction from its wide open position for cold enrichment and in the opposite direction from its wide open position for closed loop control of the air-fuel ratio during warm engine operation. The choke mechanism also includes a fast idle cam to limit closure of the throttle in the cold enrichment mode but not in the closed loop mode. The choke mechanism further includes a stop member which limits power enrichment in the closed loop mode but not in the cold enrichment mode. In addition, the choke mechanism positions an idle bleed valve to control the idle air-fuel ratio both in the closed loop mode in the cold enrichment mode. Furthermore, the choke mechanism disengages a latch which normally prevents the secondary air valve from opening in the cold enrichment mode and in the closed loop mode, thus permitting the secondary air valve to open in an open loop mode when the choke plate is near its wide open position.

The details as well as other features and advantages of this invention are set forth in the remainder of the specification and are shown in the accompanying drawings.

BEST MODE FOR CARRYING OUT THE INVENTION

Figure 1:
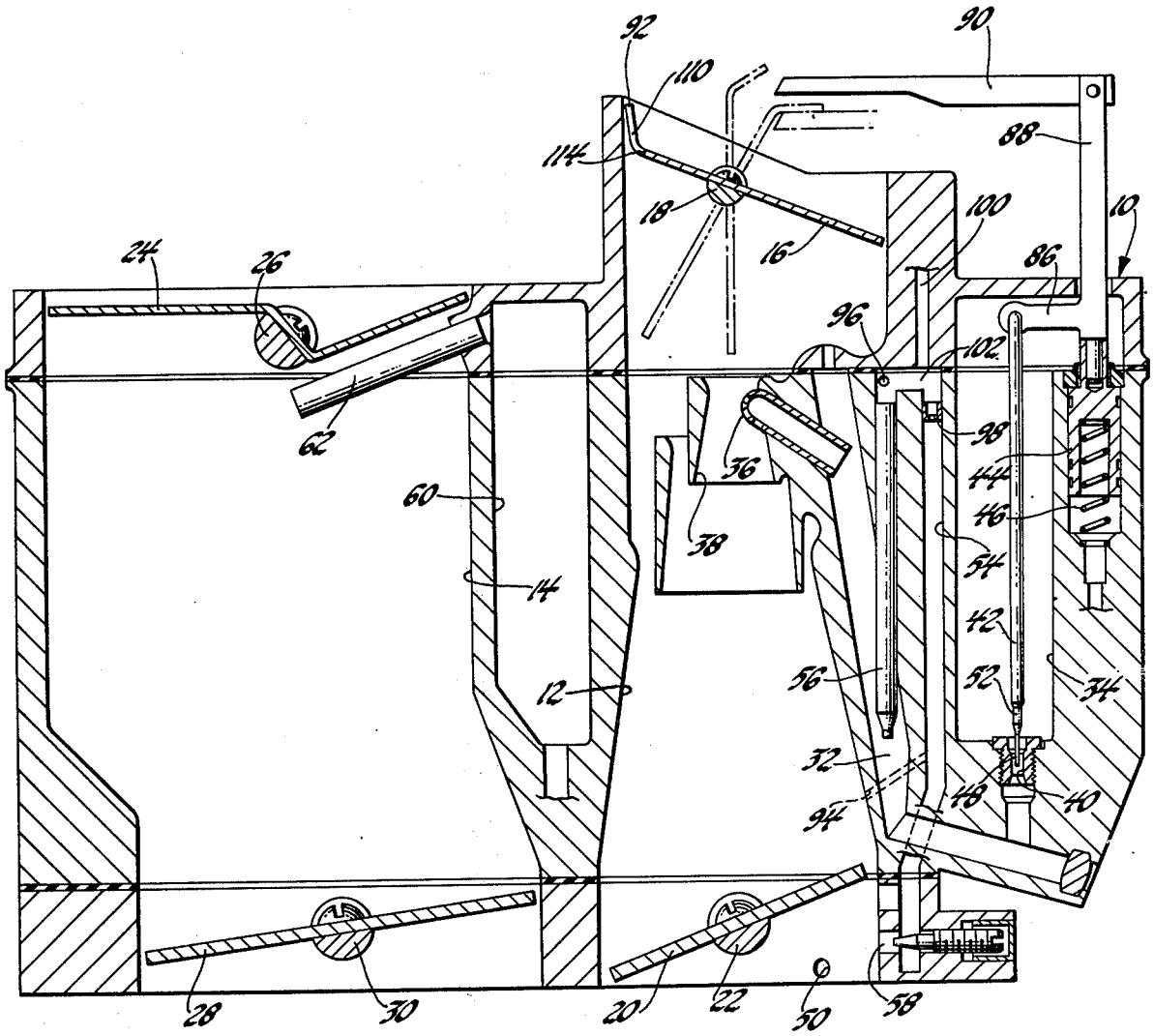
FIG. 1 is a schematic sectional view of the primary and secondary induction passages of a carburetor employing this invention and showing the operation of the stop member to limit power enrichment in the closed loop mode.

Referring first to FIG. 1, an internal combustion engine carburetor 10 has a primary induction passage 12 and a secondary induction passage 14. A choke plate 16 is disposed in primary induction passage 12 on a choke shaft 18, and a primary throttle 20 is disposed in primary induction passage 12 on a primary throttle shaft 22. An air valve 24 is disposed in secondary induction passage 14 on an air valve shaft 26, and a secondary throttle 28 is disposed in secondary induction passage 14 on a secondary throttle shaft 30.

A primary main fuel passage 32 extends from a carburetor fuel bowl 34 to a primary nozzle 36 which discharges into a venturi cluster 38 disposed in primary induction passage 12 between choke plate 16 and throttle 20. A metering orifice 40 is disposed in primary fuel passage 32 and is controlled by a metering rod 42 which is positioned by a power piston 44. Piston 44 is biased upwardly by a spring 46 to position the small tip 48 of metering rod 42 in metering orifice 40 to allow maximum fuel flow through primary fuel passage 32 for power enrichment. Piston 44 is exposed to the manifold vacuum at a port 50 opening from primary induction passage 12; upon an increase in manifold vacuum (or a decrease in manifold pressure) at port 50, piston 44 is moved downwardly against the bias of spring 46 to position the enlarged step 52 of metering rod 42 in metering orifice 40 to limit fuel flow through primary fuel passage 32.

As throttle 20 is opened to increase air flow through induction passage 12, the pressure in venturi cluster 38 sensed by fuel nozzle 36 decreases (the vacuum increases) to increase fuel flow from fuel bowl 34 through orifice 40, passage 32 and nozzle 36 into induction passage 12. Fuel flow is thus proportioned to air flow, and the proportion is determined by the position of metering rod 42 in orifice 40—a higher proportion providing the enriched air-fuel mixture required during power operation at low manifold vacuums when spring 46 lifts piston 44 and metering rod 42, and a lower proportion providing the lean air-fuel mixture desired for economical operation at high manifold vacuums when piston 44 lowers metering rod 42.

An idle fuel passage 54 has a fuel pickup tube 56 opening from primary main fuel passage 32 and extends to an idle discharge port 58 opening into primary induction passage 12 downstream of throttle 20.

A secondary main fuel passage 60 extends from fuel bowl 34 to a secondary fuel nozzle 62 opening into secondary induction passage 14 between air valve 24 and throttle 28. Fuel flow through secondary fuel passage 60 is controlled in a conventional manner; for example, a metering rod may be positioned by air valve 24 to proportion fuel flow through passage 60 to air flow through induction passage 14 as in the well known "Quadrajet"* carburetor.

*Trademark

Figure 2:
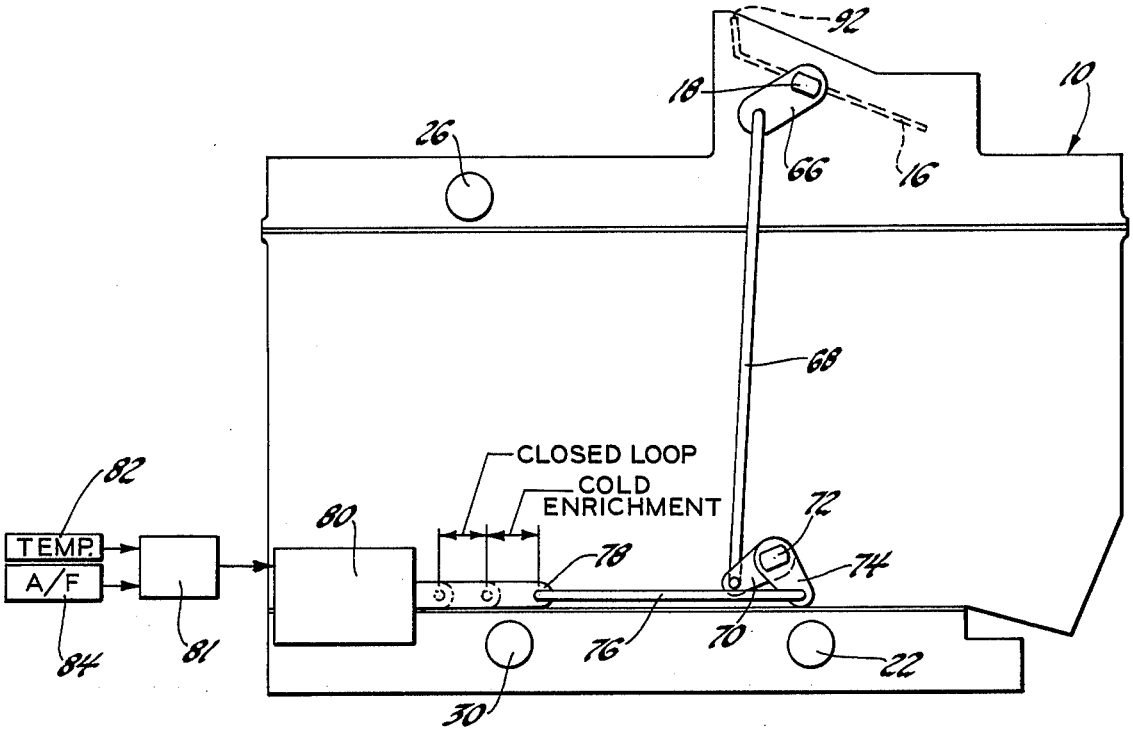
FIG. 2 is a schematic side view of the carburetor showing the operation of the choke mechanism driver.

As shown in FIG. 2, a choke lever 66 secured to choke shaft 18 is connected by a link 68 to an intermediate lever 70 secured to an intermediate shaft 72. An operating lever 74 secured to intermediate shaft 72 is connected by a link 76 to a driver 78. Across an initial region of travel, driver 78 moves choke plate 16 from the position shown through an angle of about 70° to its wide open position; across a further region of travel, driver 78 moves choke plate 16 past its wide open position through an angle of about 30° to a partially closed position.

When choke plate 16 is in a position other than its wide open position, it decreases the pressure (increases the vacuum) in venturi cluster 38 to increase fuel flow from nozzle 36. Choke plate 16 thus causes enrichment of the air-fuel mixture produced by the carburetor, with the degree of enrichment increasing as choke plate 16 is moved further from its wide open position.

It is contemplated that driver 78 will be positioned in its initial region of travel when the engine is started and as it warms to a normal operating temperature; accordingly that initial region is termed the cold enrichment region and the choke mechanism is said to be operating in a cold enrichment mode at such times. It is further contemplated that driver 78 will be positioned in its further region of travel when the engine has warmed to a normal operating temperature and enrichment is desired to, for example, maintain the measured air-fuel ratio at a constant, perhaps stoichiometric, level; accordingly that further region is termed the closed loop region and the choke mechanism is said to be operating in a closed loop mode at such times.

Driver 78 may be positioned manually or by any of a variety of devices, such as a stepping motor 80 driven by an electronic control 81 in response to signals from a sensor 82 responsive to an operating temperature and a sensor 84 responsive to the air-fuel ratio of the mixture produced by carburetor 10.

When operating in a closed loop mode under control of sensor 84, it would be undesirable to allow power piston 44 to move upwardly and provide a highly enriched air-fuel mixture. Accordingly, as shown in FIG. 1, a bracket 86 which is mounted on power piston 44 and carries metering rod 42 includes an extension 88 carrying an arm 90. Arm 90 is engaged by a stop vane 92 formed on choke plate 16 to prevent upward movement of power piston 44 when choke plate 16 is positioned in the closed loop region.

Figure 3:
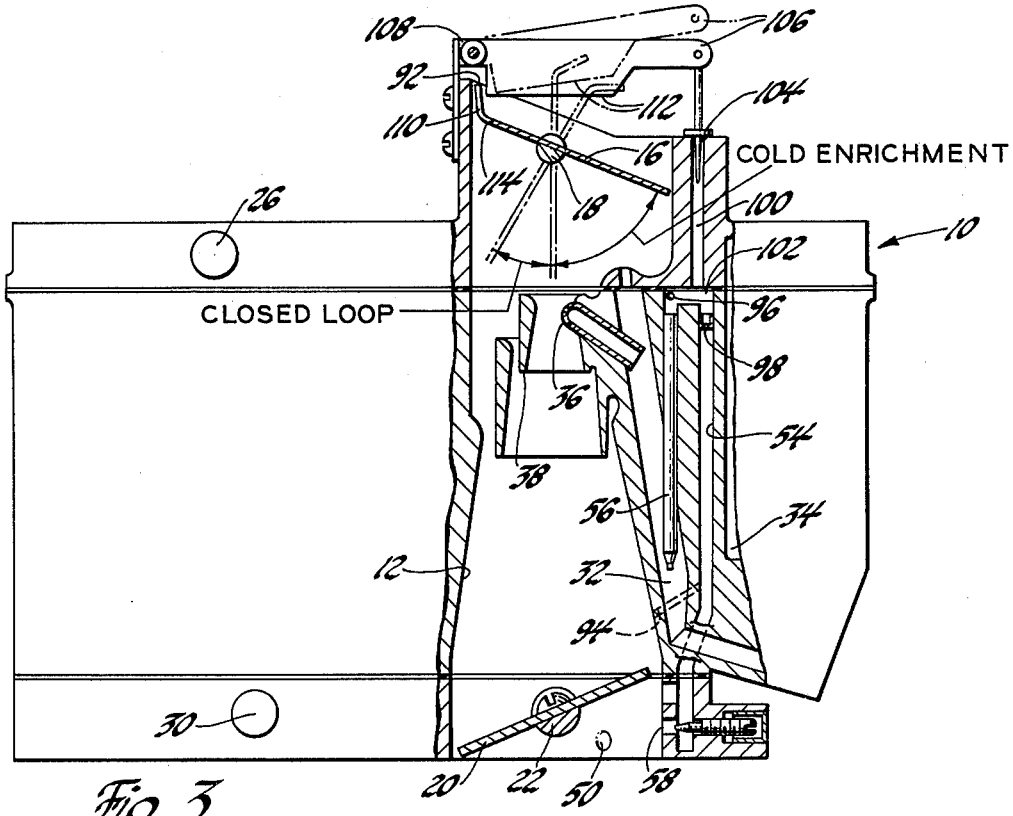
FIG. 3 is a schematic partially sectional view of the carburetor showing the operation of the idle bleed valve.

As shown in FIG. 3, the usual lower idle air bleed 94 and side idle air bleed 96 open into idle fuel passage 54 on opposite sides of a restriction 98, and an additional air bleed passage 100 opens into the upper portion 102 of idle fuel passage 54. A bleed valve 104 controls air flow through bleed passage 100. Bleed valve 104 is carried by a lever 106 pivotally mounted on a bracket 108. Lever 106 is received in a slot 110 in the choke vane 92 and has a lower surface 112 which engages the bottom 114 of slot 110. As choke plate 16 moves from its wide open position, lever 106 lowers bleed valve 104 to restrict air flow through bleed passage 100. Accordingly, as choke plate 16 moves from its wide open position to increase fuel flow from nozzle 36, bleed valve 104 restricts air flow through bleed passage 100 to increase fuel flow through idle fuel passage 54 to idle discharge port 58. The lower surface 112 of lever 106 may be contoured to achieve any desired correlation between the position of choke plate 16 and the position of bleed valve 104.

Figure 4:
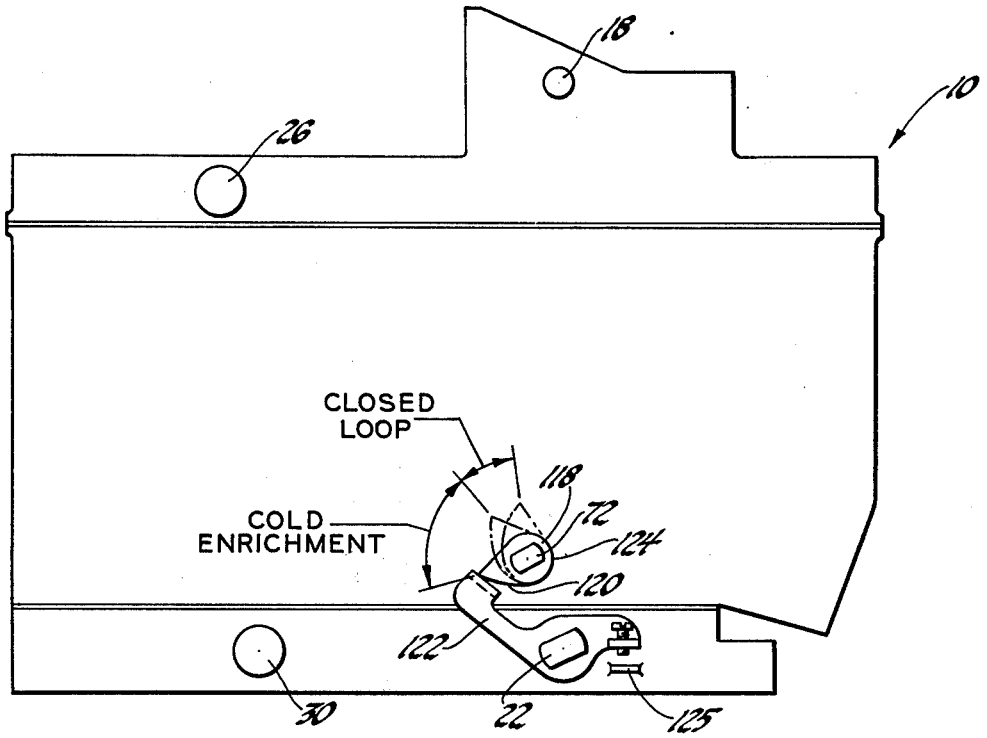
FIG. 4 is a schematic side view of the carburetor showing the operation of the fast idle cam.

As shown in FIG. 4, a fast idle cam 118 is secured on intermediate shaft 72 and has a cam surface 120 engaging the end of a lever 122 secured to primary throttle shaft 22; fast idle cam 118 thus limits closure of throttle 20 to a fast idle position to increase the engine idle speed. As choke plate 16 is moved from the closed position shown to its wide open position during the cold enrichment mode, fast idle cam rotates to allow additional closure of primary throttle 20 to a curb idle position. During operation in the closed loop mode, however, the surface 124 of cam 118 is circular to provide a constant curb idle position for primary throttle 20. If desired, a separate curb idle stop 125 may be provided to preclude lever 122 from engaging surface 124.

Figure 5:
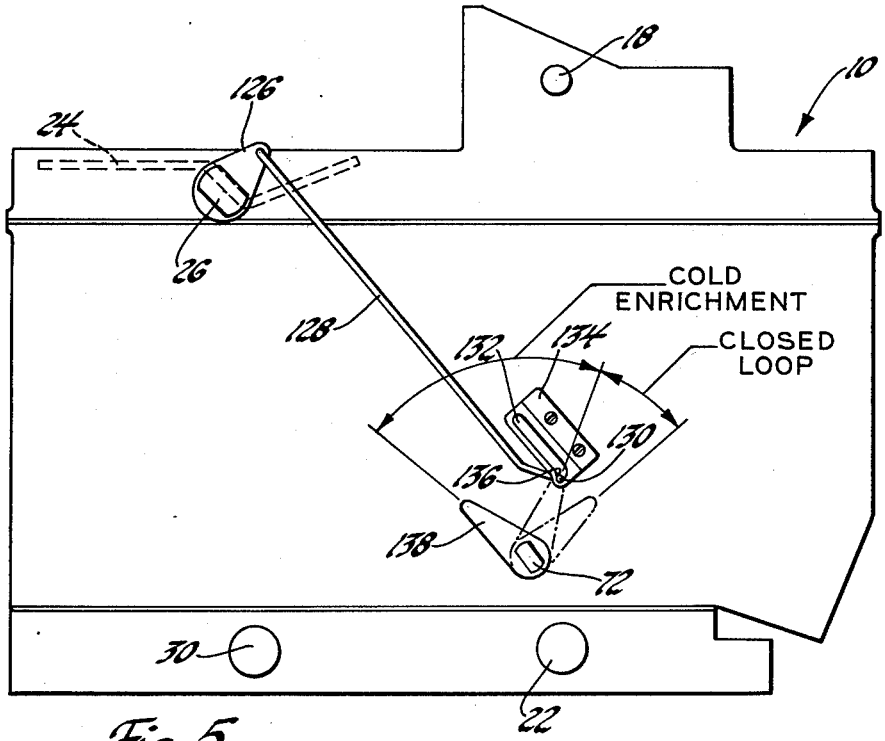
FIG. 5 is a schematic side view of the carburetor showing the operation of the secondary air valve latch.

Referring to FIG. 5, an air valve lever 126 secured to air valve shaft 26 has a latching link 128, the end 130 of which rides in the slot 132 of a bracket 134. When the end 130 of link 128 is engaged in the detent 136 of slot 132, air valve 24 is restrained from opening. An unlatching arm 138 is secured to intermediate shaft 72 and disengages the end 130 of link 128 from detent 136 as choke plate 16 reaches its wide open position. Thus air valve 24 is permitted to open only when driver 78 is operating in an open loop region between the cold enrichment region and the closed loop region and choke plate 16 is near its wide open position. This construction accordingly minimizes air flow through secondary induction passage 14 during operation in the cold enrichment mode when air flow should be limited to prevent excess engine speed and also minimizes air and fuel flow through secondary induction passage 14 during operation in the closed loop mode when choke plate 16 is positioned to maintain a constant air-fuel ratio.

The construction of carburetor 10 is particularly advantageous in its ability to automatically produce the air-fuel mixture required for power operation even though the carburetor has been operating in the closed loop mode. As the operator opens the throttles to command power operation, manifold vacuum drops and spring 46 lifts piston 44 and metering rod 42 until arm 90 engages stop vane 92. This richens the mixture beyond the stoichiometric point, and driver 78 starts moving choke plate 16 toward its wide open position in an attempt to maintain a stoichiometric air-fuel ratio. As choke plate 16 is opened, however, arm 90 follows and metering rod 42 is lifted to further increase fuel flow. When choke plate 16 reaches its wide open position, latching link 128 is disengaged from detent 136 to allow flow through secondary induction passage 14. The carburetor then continues to operate in an open loop mode until closure of the throttles allows air valve 24 to close and increases manifold vacuum to pull piston 44 downwardly against spring 46. Thus when the operator commands power operation, the choke plate is moved to its wide open position and the carburetor reverts to an open loop mode of operation. (If necessary, motor 80 may be controlled to prevent movement of driver 78 into the cold enrichment region in response to signals from air-fuel ratio sensor 84.)

The embodiments of the invention in which an exclusive property or privilege is claimed are defined as follows:

1. A carburetor comprising an induction passage, a fuel passage extending to a fuel nozzle opening into said induction passage, a metering apparatus movable between a lean position restricting flow through said fuel passage and a rich position permitting increased flow through said fuel passage, and a choke mechanism including a choke plate in said induction passage upstream of said nozzle and movable from a wide open position for decreasing the pressure adjacent said nozzle and thus effecting increased fuel flow from said nozzle, wherein said choke mechanism includes a driver mechanically connected to said choke plate and operable both in a cold enrichment region and in a closed loop region for moving said choke plate from its wide open position, and wherein said choke mechanism further includes a stop member physically engaged by said metering apparatus for limiting movement of said metering apparatus toward said rich position when said driver is operating in said closed loop region but not when said driver is operating in said cold enrichment region, whereby said driver may be operated in said closed loop region for both effecting increased fuel flow from said nozzle and limiting movement of said metering apparatus toward said rich position and in said cold enrichment region for effecting increased fuel flow from said nozzle without limiting movement of said metering apparatus toward said rich position.

2. A carburetor comprising an induction passage, a throttle in said induction passage, a main fuel passage extending to a fuel nozzle opening into said induction passage upstream of said throttle, a choke mechanism including a choke plate in said induction passage upstream of said nozzle and rotatable from a wide open position for decreasing the pressure adjacent said nozzle and thus effecting increased fuel flow from said nozzle, an idle fuel passage extending to a discharge port opening into said induction passage downstream of said throttle, and an air bleed opening into idle fuel passage, wherein said choke mechanism is operable for rotating said choke plate in a first direction from its wide open position during a cold enrichment mode and in a second direction from its wide open position during a closed loop mode, and wherein said carburetor further comprises a bleed valve actuated by said choke mechanism upon rotation of said choke plate in each direction from its wide open position for decreasing air flow through said bleed and thus effecting increased fuel flow from said discharge port both in said closed loop mode and in said cold enrichment mode.

3. A carburetor comprising an induction passage, a throttle in said induction passage, a main fuel passage extending to a fuel nozzle opening into said induction passage upstream of said throttle, a metering apparatus movable between a lean position restricting flow through said fuel passage and a rich position permitting increased flow through said fuel passage, a choke mechanism including a choke plate in said induction passage upstream of said nozzle and rotatable from a wide open position for decreasing the pressure adjacent said nozzle and thus effecting increased fuel flow from said nozzle, an idle fuel passage extending to a discharge port opening into said induction passage downstream of said throttle, and an air bleed opening into said idle fuel passage, wherein said choke mechanism includes a driver operable for rotating said choke plate in one direction from its wide open position during a cold enrichment mode and in the opposite direction from its wide open position during a closed loop mode, wherein said choke mechanism also includes a fast idle cam effective upon rotation of said choke plate in said one direction for limiting closure of said throttle to a fast idle position during said cold enrichment mode and effective upon rotation of said choke plate in said opposite direction for permitting closure of said throttle to a curb idle position during said closed loop mode, wherein said choke mechanism additionally includes a stop member effective upon rotation of said choke plate in said opposite direction for limiting movement of said metering apparatus toward said rich position during said closed loop mode but not upon rotation of said choke plate in said one direction during said cold enrichment mode, and wherein said carburetor further comprises a bleed valve actuated by said choke mechanism upon rotation of said choke plate in each direction from said wide open position for decreasing air flow through said bleed and thus effecting increased fuel flow from said discharge port both during said closed loop mode and during said cold enrichment mode.

4. A carburetor comprising primary and secondary induction passages, a fuel nozzle opening into said primary induction passage, a choke mechanism including a choke plate in said primary induction passage upstream of said nozzle and movable from a wide open position for decreasing the pressure adjacent said nozzle and thus effecting increased fuel flow from said nozzle, and means including a valve in said secondary induction passage and movable from a closed positon for permitting increased flow through said secondary induction passage, wherein said choke mechanism includes a driver operable both in a cold enrichment region and in a closed loop region for moving said choke plate from its wide open position, wherein said carburetor further comprises a latching member engaged to prevent movement of said valve from said closed position, and wherein said choke mechanism also includes means for disengaging said latching member to permit movement of said valve from said closed position only when said driver is operating in an open loop region between said closed loop region and said cold enrichment region and said choke plate is near its wide open position.

5. A carburetor comprising primary and secondary induction passages, primary and secondary throttles respectively disposed in said induction passages, primary and secondary fuel passages respectively extending to primary and secondary fuel nozzles respectively opening into said induction passages upstream of said throttles, metering apparatus movable between a lean position restricting flow through said primary fuel passage and a rich position permitting increased flow through said primary fuel passage, a choke mechanism including a choke plate in said primary induction passage upstream of said primary nozzle and rotatable from a wide open position for decreasing the pressure adjacent said primary nozzle and thus effecting increased fuel flow from said primary nozzle, an idle fuel passage extending to a discharge port opening into one of said induction passages downstream of said throttle, an air bleed opening into said idle fuel passage, means including an air valve in said secondary induction passage and movable from a closed position for permitting increased flow through said secondary induction passage, wherein said choke mechanism includes a driver operable at one time in a cold enrichment region for rotating said choke plate in one direction from its wide open position and operable at another time in a closed loop region for rotating said choke plate in the opposite direction from its wide open position, wherein said choke mechanism also includes a fast idle cam for limiting closure of said throttle to a fast idle position when said driver is operating in said cold enrichment region and for permitting closure of said throttle to a curb idle position when said driver is operating in said closed loop region, wherein said choke plate additionally includes a stop vane for engaging and thereby limiting movement of said metering apparatus toward said rich position when said driver is operating in said closed loop region but not when said driver is operating in said cold enrichment region, wherein said carburetor further comprises a bleed valve positioned by a pivoted lever, wherein said choke plate is adapted to engage said lever upon rotation in each direction from its wide open position to position said bleed valve for decreasing air flow through said bleed and thus effecting increased fuel flow from said discharge port both when said driver is operating in said closed loop region and when said driver is operating in said cold enrichment region, wherein said carburetor in addition comprises a latching member engaged to prevent movement of said air valve from said closed position, and wherein said choke mechanism includes means for disengaging said latching member to permit movement of said air valve from said closed position only when said driver is operating in an open loop region between said closed loop region and said cold enrichment region and said choke plate is near its wide open position.

* * * * *